US012767369B2

(12) United States Patent
Sun

(10) Patent No.: US 12,767,369 B2
(45) Date of Patent: Oct. 20, 2026

(54) LAMINATED PACKAGE HOT FILLING STERILIZATION AND DEVICE USING SAME

(71) Applicant: A. T. P. CO., LTD., Taipei (TW)

(72) Inventor: Hsi-Tai Sun, Taipei (TW)

(73) Assignee: A. T. P. CO., LTD., Taipei (TW)

( * ) Notice: Subject to any disclaimer, the term of this patent is extended or adjusted under 35 U.S.C. 154(b) by 159 days.

(21) Appl. No.: 18/641,431

(22) Filed: Apr. 22, 2024

(65) Prior Publication Data

US 2024/0359851 A1 Oct. 31, 2024

(30) Foreign Application Priority Data

Apr. 26, 2023 (TW) ..... 112115647

(51) Int. Cl.

| | |
|---|---|
| ***B65B 55/06*** | (2006.01) |
| ***B65B 3/00*** | (2006.01) |
| ***B65B 55/02*** | (2006.01) |
| ***B65B 55/14*** | (2006.01) |
| ***B65D 65/40*** | (2006.01) |

(52) U.S. Cl.

CPC ..... *B65B 55/06* (2013.01); *B65B 3/00* (2013.01); *B65B 55/025* (2013.01); *B65B 55/14* (2013.01); *B65D 65/40* (2013.01); *B65B 2220/24* (2013.01)

(58) Field of Classification Search

CPC ..... B65B 55/06; B65B 3/00; B65B 55/14; B65B 2220/24; B65B 55/025; B65D 65/40

USPC ..... 53/425

See application file for complete search history.

(56) References Cited

U.S. PATENT DOCUMENTS

| | | | | |
|---|---|---|---|---|
| 4,040,233 | A * | 8/1977 | Valyi | B32B 27/00 264/513 |
| 5,251,424 | A * | 10/1993 | Zenger | B67C 3/045 53/471 |
| 5,494,691 | A * | 2/1996 | Sizer | B65B 55/14 426/399 |
| 5,804,240 | A | 9/1998 | Madlener | |
| 7,169,420 | B2 * | 1/2007 | Korengel | A23B 2/22 426/399 |

(Continued)

FOREIGN PATENT DOCUMENTS

| | | |
|---|---|---|
| CN | 101378963 | 3/2009 |
| CN | 213881635 | 8/2021 |

(Continued)

*Primary Examiner* — Himchan Song
(74) *Attorney, Agent, or Firm* — Che-Yang Chen

(57) ABSTRACT

A method for hot-filling and sterilizing laminated packages, comprising a pre-heating step, a hot-filling and sterilizing step, a holding step, and a rapid cooling step. The pre-heating step is to perform high-temp-short-time sterilization and to keep the product at the controlled temperature within the first-time interval. The hot-filling sterilization step is to fill up the laminated package with the product after sterilization. The package is sealed and sterilized by the heat from the product. The holding step is to keep the laminated package and the product at an effective sterilization temperature within the second time interval and to achieve the safety standard of sufficient sterilization. The rapid cooling step is to rapidly cool down the filled package within the third time interval and to prevent the product from deteriorating due to overheating. A device utilizing the aforementioned method is also provided.

13 Claims, 1 Drawing Sheet

(56) References Cited

U.S. PATENT DOCUMENTS

| | | | | |
|---|---|---|---|---|
| 9,517,853 | B2 * | 12/2016 | Koolhaas | B65B 53/06 |
| 2004/0131735 | A1 * | 7/2004 | Korengel | A23B 2/22 426/399 |
| 2007/0184157 | A1 * | 8/2007 | Stegmaier | A23B 70/30 426/399 |
| 2009/0071103 | A1 * | 3/2009 | Andersson | B65B 55/12 53/425 |
| 2018/0168200 | A1 | 6/2018 | Knoerzer et al. | |
| 2019/0350229 | A1 * | 11/2019 | Watts | A23B 2/08 |
| 2020/0354550 | A1 * | 11/2020 | Takeuchi | B65D 35/40 |

FOREIGN PATENT DOCUMENTS

| | | |
|---|---|---|
| JP | 10248908 | 9/1998 |
| JP | 11313650 | 11/1999 |
| JP | 2021073882 | 5/2021 |
| TW | I309216 | 5/2009 |
| TW | 201313138 | 4/2013 |
| TW | 202119936 | 6/2021 |
| TW | M644259 | 7/2023 |

* cited by examiner

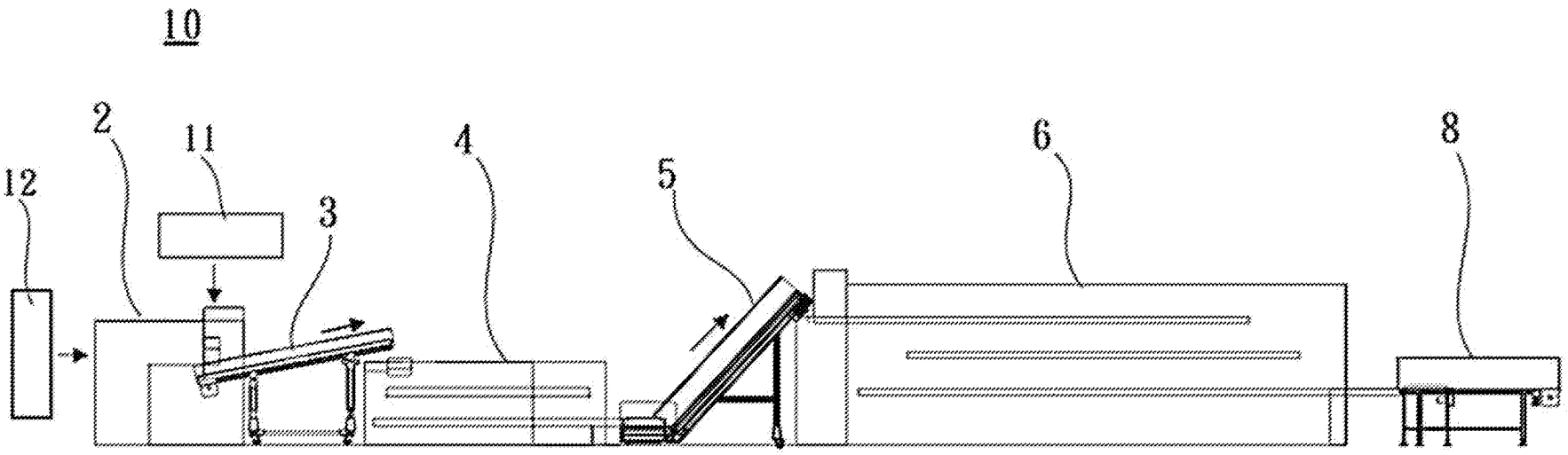
10
2
12
11
3
4
5
6
8

LAMINATED PACKAGE HOT FILLING STERILIZATION AND DEVICE USING SAME

BACKGROUND OF THE PRESENT INVENTION

Field of Invention

The invention relates to a food packaging technology, and in particular to a laminated package food hot filling and sterilization method and equipment.

Description of Related Arts

Hot fill sterilization is a method used to sterilize liquid products. This method is commonly used in the food and pharmaceutical industries. The hot-fill sterilization process involves heating liquid products to high temperatures and then filling them into bottles or other containers. These containers are then sealed to prevent the entry of microorganisms and other contaminants. This method can effectively kill various microorganisms and extend the shelf life of the product. However, high-temperature operation can easily cause product properties to change and deteriorate. For food, it will affect its flavor and nutritional value. According to the concept of fence factor, acidic drinks with a pH value less than 4.6 and foods such as jelly made from them can prevent the growth of *C. botulinum* spores by controlling the pH value. Therefore, a milder heat treatment method can be used to prevent the growth of pathogenic bacteria and spoilage, and commercially, the effect of long-term storage at room temperature is achieved.

Common sterilization methods that meet the above conditions include retort sterilization and pasteurization. Retort sterilization is a method of processing whereby food is subject to high-pressure and high-temperature steam or hot water. This method can effectively kill various microorganisms to ensure the sterility of products. However, this method requires the use of expensive equipment in and between process steps and may not be feasible for some products. In addition, product loading or unloading from sterilization retorts is a batch operation and quite time-consuming, which is not conducive to increasing production capacity.

The pasteurization is to heat products at high temperatures for a period of time to kill most spoilage bacteria, molds, yeasts and non-sporulating pathogenic bacteria. This method is widely used in the food processing and medical industries. Pasteurization requires the use of a pasteurizer or pasteurization equipment that utilizes high-pressure steam or a heat exchanger for high-temperature sterilization. Pasteurizers usually consist of one or more heated chambers and can operate at a certain temperature and pressure. They can also have automatic control systems to monitor and control temperature and pressure. Considerable space is required for these equipment to pasteurization.

Therefore, the main purpose of the present invention is to provide a method for hot filling and sterilization of laminated packages to solve the problems faced by the above-mentioned conventional methods.

The information disclosed in this "Background of the Present Invention" Section is only for enhancement understanding of the background of the invention and therefore it may contain information that does not form the prior art that is already known to a person of ordinary skill in the art. Furthermore, the information disclosed in this "Background of the Present Invention" section does not mean that one or more problems to be solved by one or more embodiments of the invention was acknowledged by a person of ordinary skill in the art.

SUMMARY OF THE PRESENT INVENTION

The invention provides a method of hot-filling and sterilizing a laminated package, which comprises a pre-heating step, which comprises performing a high-temp-short-time sterilization on a product within a first time interval; a hot-filling and sterilizing step, which comprises filling the product into the laminated package after the high-temp-short-time sterilization, and sealing the laminated package to use the temperature of the product to sterilize the laminated package; a holding step, which comprises maintaining the laminated package and the product at an effective sterilization temperature within a second time interval; and a rapid cooling step, which comprises rapid cooling the laminated package filled with the product within a third time interval.

In an embodiment, the product is an acidic product with a pH value less than 4.6, wherein the acidic product could be a fruit juice, a derivative of fruit juice, or a flavored and acidified drink.

In an embodiment, the first time interval is about 5-15 seconds, and the temperature at which the product is subjected to the high-temp-short-time sterilization is about 90-110° C.

In an embodiment, the temperature of the product filled into the laminated package is about 80-100° C., the effective sterilization temperature is the temperature of the product when the product is filled into the laminated package, and the second time interval is about 1-3 minutes, and the holding step is performed in a heating and insulating tunnel.

In an embodiment, the third time interval is about 5-7 minutes, and the laminated package and the product are cooled from 80-100° C. to 20-40° C. during the third time interval, and the rapid cooling step is carried out in a rapid cooling tunnel.

In an embodiment, the laminated package filled with the product in the hot-filling and sterilizing step is sent into the heating and insulating tunnel through a first continuous conveyor belt, heated and insulated while passing through the heating and insulating tunnel, and then sent into the rapid cooling tunnel through a second continuous conveyor belt for rapid cooling.

In an embodiment, the laminated package filled with the product is heated and kept warm by non-liquid phase heating during the second time interval, and rapidly cooled by non-liquid phase cooling during the third time interval, while the surface of the laminated package is kept dry throughout the pre-heating step, the hot-filling and sterilizing step, the holding step, and the rapid cooling step.

The invention further provides a laminated packaging material hot filling and sterilization equipment, which comprises a packaging machine for filling a product into a laminated package and sealing the laminated package, so that the temperature of the product is utilized to sterilize the laminated package, wherein before filled into the laminated package, the product is processed with a high-temp-short-time sterilization within a first time interval; a heating and insulating tunnel, connected to the packaging machine, for receiving the laminated package, which is filled with the product and sealed, from the packaging machine, and maintaining the laminated package and the product at an effective sterilization temperature within a second time interval; and a rapid cooling tunnel, connected to the heating and insulating tunnel for rapidly cooling the laminated package filled with the product sent from the heating and insulating tunnel within a third time interval.

In an embodiment, the product is an acidic product with a pH value less than 4.6, and the acidic product could be a fruit juice, a derivative of fruit juice, or a flavored and acidified drink.

In an embodiment, the first time interval is about 5-15 seconds, and the temperature at which the product is subjected to the high-temp-short-time sterilization is about 90-110° C.

In an embodiment, the temperature of the product when the product is filled into the laminated package is about 80-100° C., the effective sterilization temperature is the temperature when the product is filled into the laminated package, and the second time interval is about 1-3 minutes.

In an embodiment, the third time interval is about 5-7 minutes, and the laminated package and the product are cooled from 80-100° C. to 20-40° C. during the third time interval.

In an embodiment, the equipment further comprises a first continuous conveyor belt or a second continuous conveyor belt, wherein the first continuous conveyor belt is connected between the packaging machine and the heating and insulating tunnel for sending the laminated package filled with the product in the packaging machine into the heating and insulating tunnel, wherein the second continuous conveyor belt is connected between the heating and insulating tunnel and the rapid cooling tunnel for sending the laminated package, filled with the product and heated and insulated in the heating and insulating tunnel, to the rapid cooling tunnel for rapid cooling.

In an embodiment, the laminated package filled with the product is heated and kept warm by non-liquid phase heating during the second time interval, and is performed a rapid cooling using non-liquid phase cooling in the third time interval, and the surface of the laminated package is kept dry throughout the packaging machine, the heating and insulating tunnel, and the rapid cooling tunnel.

In an embodiment, the equipment further comprises a backend inline packaging station connected to the rapid cooling tunnel for receiving the laminated product that has been rapidly cooled and transferred from the rapid cooling tunnel for packaging.

Other advantages and objects of the invention may be further illustrated by the technical features broadly embodied and described as follows.

By Utilizing the laminated package hot filling and sterilization method and equipment provided by the present invention, while the product has just been processed by a high-temp-short-time sterilization, the laminated package is sterilized by the temperature of the product itself, and the heating and insulation equipment is used in the latter stage according to the desired product quality, so that the product is kept in a desired temperature for a specific period of time and then rapidly cooled down through the rapid cooling tunnel. Accordingly, it is capable to eliminate the steps of intermediate heating, loading, unloading, and cooling, and the appearance of the laminated package is less likely to be damaged. In addition, by keeping the sterilized products in a dry state, the labor and energy consumption of drying can be saved to meet the needs of use.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The drawings are included to provide a further understanding of the embodiments of the present application, and constitute a part of the specification for illustrating the embodiments of the present application and together with the written description, to explain the principles of the present application. Obviously, the drawings in the following description are only some embodiments of the present application. For those of ordinary skill in the art, other drawings can be obtained based on these drawings without exerting creative efforts. In the diagram:

FIG. 1 is a schematic diagram of the equipment used in an embodiment of the laminated package hot filling and sterilization method of the present invention and its operation flow.

DETAILED DESCRIPTION OF THE PREFERRED EMBODIMENT

Specific structural and functional details disclosed herein are representative only and are provided for the purpose of describing exemplary embodiments of the invention. This invention may, however, be embodied in many alternative forms and should not be construed as limited only to the embodiments set forth herein.

In the description of the present invention, it should be understood that the orientations or positional relationships indicated by the terms "center", "lateral", "upper", "lower", "left", "right", "vertical", "horizontal", "top", "bottom", "inner", "outer", etc. are based on the orientations or positional relationships shown in the drawings. They are only for the convenience of describing the present invention and simplifying the description, and do not indicate or imply the following. Indicated devices or components must have a specific orientation, be constructed and operate in a specific orientation and therefore are not to be construed as limitations of the invention. In addition, the terms "first" and "second" are used for descriptive purposes only and cannot be understood as indicating or implying relative importance or implicitly indicating the quantity of indicated technical features. Therefore, features defined as "first" and "second" may explicitly or implicitly include one or more of these features. In the description of the present invention, unless otherwise specified, "plurality" means two or more. In addition, the term "includes" and any variations thereof are intended to cover non-exclusive inclusion.

In the description of the present invention, it should be noted that, unless otherwise clearly specified and limited, the terms "installation", "connection" and "connection" should be understood in a broad sense. For example, it can be a fixed connection. It is a detachable connection or an integral connection; it can be a mechanical connection or an electrical connection; it can be a direct connection or an indirect connection through an intermediate medium; it can be an internal connection between two components. For those of ordinary skill in the art, the specific meanings of the above terms in the present invention can be understood on a case-by-case basis.

The terminology used herein is for the purpose of describing particular embodiments only and is not intended to be limiting of the exemplary embodiments. As used herein, the singular forms "a" and "an" are intended to include the plural referents as well, unless the context clearly dictates otherwise. It will also be understood that the terms "comprising" and/or "including" as used herein specify the presence of stated features, integers, steps, operations, units and/or components without excluding the presence or addition of one or more other characteristics, integers, steps, operations, units, components and/or combinations thereof.

Generally, traditional acidified cans are packaged in glass bottles or aluminum cans. The present invention uses laminated packages. The laminated package referred to here refers to a soft, flexible, deformable material, made of multi-layer composite materials, including PET, ALP, Nylon, CPP, RCPP and other materials (but not limited to these), and has good sealing, protection and printing, can effectively isolate external gas and moisture, slow down the oxidation and deterioration of products, and provide high strength and wear resistance. Because of its advantages of being lightweight, economical, easy to store and transport, it can significantly increase the value of goods while effectively reducing costs and improving commercial applicability.

The laminated package hot filling and sterilizing method of the present invention includes procedures such as pre-heating step, hot-filling and sterilizing step, holding step, and rapid cooling step performed in sequence. The pre-heating step is a high-temp-short-time sterilization of the product. Due to the high sterilization temperature, this step needs to be completed within a very short first time interval to avoid deteriorating the quality of the product due to overheating. The sterilization temperature in this step can be adjusted according to different conditions such as the type and nature of the product/laminated package and the size of the packaging volume. After the high-temp-short-time sterilization treatment of the pre-heating step, the product can then be filled into the laminated package through the hot-filling and sterilizing step, and the laminated package can be sealed. At this moment, the product has just been processed by a high-temperature heating and still maintains at a high temperature within the effective sterilization temperature range. Accordingly, the laminated package is sterilized by the temperature of the product which is filled therewith.

After the laminated package is initially sterilized with high-temperature products in the hot-filling and sterilizing step, the laminated package needs to be maintained at a temperature that can effectively sterilize for a period of time to further enhance the sterilization effect. The holding step is to keep the laminated package and product at an effective sterilization temperature within the second time interval, such as the temperature when the product is filled into the laminated package. If the temperature of the product drops prematurely to a temperature that cannot be effectively sterilized, it may result in insufficient sterilization and the product cannot be stored for a long time. If the product is kept at a high temperature for too long, it may cause the product to be overheated and deteriorate its quality. Therefore, a precise temperature and time control mechanism is required when operating the holding step. This step should be completed after the product sealed in the laminated package has been fully sterilized.

After the product in the sealed laminated package has been fully sterilized after undergoing hot filling sterilization and holding step, if the product is still maintained at the sterilization high temperature, it will begin to deteriorate significantly. Therefore, the rapid cooling step needs to be performed immediately after the second time Executed within the third time interval of the interval to rapidly cool down the laminated package charged into the product. The third time interval should also not be too long. Rapid cooling should usually be completed within a few minutes and the product should be cooled to normal temperature. After cooling to normal temperature, the products can be further packaged in batches.

The laminated package filled with the product is heated and kept warm by non-liquid phase heating in the second time interval, and rapidly cooled by non-liquid phase cooling in the third time interval, and the surface of the laminated package is kept dry throughout the process in the pre-heating step, the hot-filling and sterilizing step, the holding step, and the rapid cooling step. Therefore, the product after hot filling sterilization and rapid cooling will remain in a dry state, thus saving labor and energy losses in drying in the conventional technology.

FIG. 1 is a schematic diagram of equipment and its operation flow that can implement the laminated package hot filling and sterilization method provided by the present invention. The laminated packaging material hot filling and sterilization equipment 10 includes a packaging machine 2, a first continuous conveyor belt 3, a heating and insulating tunnel 4, a second continuous conveyor belt 5, a rapid cooling tunnel 6, and a backend inline packaging station 8, which are connected to each other in sequence. Preferably, the heating and insulating tunnel 4 and the rapid cooling tunnel 6 each have a product conveying mechanism to convey the product (such as a filled and sealed laminated package) from the tunnel entrance to the exit, in conjunction with the first continuous conveyor belt 3 and the second continuous conveyor belt. The conveyor belt 5 can achieve continuous operation and production of multiple laminated packages, but the present invention is not limited to this.

The packaging machine 2 is used to fill the product 11 that has undergone high-temp-short-time sterilization into the laminated package 12 and seal the laminated package 12. The laminated package 12 filled with product 11 and sealed is sent from the packaging machine 2 to the entrance of the heating and insulating tunnel 4 by the first continuous conveyor belt 3 while still at a high temperature that meets the sterilization standards. In other words, the temperature when the product 11 is filled into the laminated package 12 is within a temperature range that can effectively sterilize.

The heating and insulating tunnel 4 can keep the laminated package 12 and its product 11 within a temperature range that can effectively sterilize, such as maintaining the temperature when the product 11 is filled into the laminated package 12, to further enhance the sterilization effect and meet safety standards. In one embodiment, the heating and insulating tunnel 4 is divided into six areas. Each area is equipped with an air supply motor (not shown in the FIGURE) and a temperature sensing device (not shown in the FIGURE), which can accurately control the temperature of each area. The filled and sealed laminated package 12 is conveyed through these six areas by a conveying mechanism (not shown in the FIGURE) in the heating and insulating tunnel 4, with the conveying speed and precise control of the temperature of each area to maintain the product 11 (such as the filled and sealed laminated package 12) within the effective sterilization temperature range, such as the temperature when the product 11 is filled into the laminated package 12. After the product 11 is heated and kept warm for a period of time through the heating and insulating tunnel 4, it is then transported into the rapid cooling tunnel 6 through the second continuous conveyor belt 5. The rapid cooling tunnel 6 uses the circulation of the condenser (not shown) and the compressor (not shown) together with the fan (not shown) and the motor (not shown) to quickly take away the heat of the product 11, making it being cooled to normal temperature and sent to the backend inline packaging station 8 through rapid cooling tunnel 6 for direct packaging operation.

In one embodiment, the method of the present invention is applied to the laminated package packaging operation of acidic products with a pH value less than 4.6. This embodiment is particularly aimed at hot filling and sterilizing of laminated packages of juice or juice derivatives such as jelly. First, in the pre-heating step, the product 11 is first subjected to high-temp-short-time sterilization: the product 11 is sterilized at a high temperature of about 90-110° C. for about 5-15 seconds (first time interval). The prepared acidic product will be rapidly heated through a tubular heat exchanger (not shown in the FIGURE) and maintained at a high temperature for 5-15 seconds to achieve commercial sterilization conditions.

Afterwards, in the hot-filling and sterilizing step, the acidic product 11 that has undergone high-temp-short-time sterilization and has a temperature of 80-100° C. is filled into the laminated package 12 and sealed in the packaging machine 2. At this moment, the laminated package 12 is sterilized by the high temperature of the product 11, and is then sent to the heating and insulating tunnel 4 through the first continuous conveyor belt 3 to perform the holding step.

In the holding step, the product 11 is transported through the aforementioned six precise temperature control areas in the heating and insulating tunnel 4, and the temperature is maintained at 80-100° C. within 1-3 minutes (second time interval) using non-liquid phase heating. This temperature can continuously sterilize the product 11 sealed in the laminated package 12. Then, the product 11 is sent into the rapid cooling tunnel 6 with the second continuous conveyor belt 5, and the rapid cooling step is immediately performed.

In the rapid cooling step, the product 11 is cooled in the rapid cooling tunnel 6 from 80-100° C. to 20-40° C. in a non-liquid phase cooling method within 5-7 minutes (third time interval). After cooling, a plurality of the products 11 can be further packaged at the backend inline packaging station 8.

According to the specifications issued by the Food Industry Research and Development Institute (FIRDI) in Taiwan, in order to make acidified cans meet commercial sterilization requirements, *E. coli* O157:H7 is used as the sterilization indicator bacteria, and the sterilization efficiency must be higher than 10D to meet safety standards. Table 1 shows the lower limit temperature and sterilization time that meet the safety intensity of thermal sterilization of acidified products—their core temperature. (The source of information listed in Table 1 is from FIRDI).

TABLE 1

| Temperature(° C.) | Temperature (° F.) | Time(second) |
|---|---|---|
| 60 | 140 | 1350.4 |
| 70 | 158 | 161.2 |
| 80 | 176 | 19.3 |
| 81 | 177.8 | 15.5 |
| 82 | 179.6 | 12.6 |
| 83 | 181.4 | 10.2 |
| 84 | 183.2 | 8.2 |
| 85 | 185 | 6.7 |
| 86 | 186.8 | 5.4 |
| 87 | 188.6 | 4.3 |
| 88 | 190.4 | 3.5 |
| 89 | 192.2 | 2.8 |
| 90 | 194 | 2.3 |
| 91 | 195.8 | 1.9 |
| 92 | 197.6 | 1.5 |

TABLE 1-continued

| Temperature(° C.) | Temperature (° F.) | Time(second) |
|---|---|---|
| 93 | 199.4 | 1.2 |
| 94 | 201.2 | 1 |
| 95 | 203 | 0.8 |
| 96 | 204.8 | 0.7 |
| 97 | 206.6 | 0.5 |
| 98 | 208.4 | 0.4 |
| 99 | 210.2 | 0.4 |
| 100 | 212 | 0.3 |

In one embodiment, the upper and lower limits of the sterilization temperature and matching time of each step in the method of the present invention are mainly based on Table 1. At the same time, when the temperature exceeds 80° C., the sterilization time can be reduced to less than 1 minute. At the same time, in order to maintain product quality, the heating and insulating tunnel 4 of the present invention maintains the temperature at a temperature that can kill indicator bacteria, thereby better ensuring product quality.

In summary, the method and equipment for hot filling and sterilization of laminated packages provided by the present invention can be used for continuous production, saving energy, keeping the outer packaging dry during the whole process, allowing direct packaging, and reducing the temperature impact on product quality. Deterioration (browning, loss of nutrients, deterioration of flavor). Different from existing sterilization-related processes (such as retortsterilization method or pasteurization method), the "laminated package hot filling sterilization method and equipment" provided by the present invention has the ability to keep the product dry after sterilization. In order to save drying labor and energy loss, save the time of product loading and unloading the sterilization kettle, and save the steps of intermediate heating, loading and unloading, and cooling, the laminated package has the advantages of being less likely to be damaged in appearance, high productivity, and small footprint.

Through the above detailed description of the preferred embodiments, it is hoped that the characteristics and spirit of the present invention can be more clearly described, but the scope of the present invention is not limited by the preferred embodiments disclosed above. On the contrary, the intention is to cover various modifications and equivalent arrangements within the scope of the patentable application of the present invention.

What is claimed is:

1. A method of hot-filling and sterilizing a laminated package, comprising:

a pre-heating step, which comprises performing a high-temp-short-time sterilization on a product within a first time interval;

a hot-filling and sterilizing step, which comprises filling the product into the laminated package after the high-temp-short-time sterilization, and sealing the laminated package and to use the temperature of the product to sterilize the laminated package;

a holding step, which comprises maintaining the laminated package and the product at an effective sterilization temperature equal to the temperature of the product at the moment the product is filled into the laminated package, by non-liquid-phase heating in a heating and insulating tunnel, without contacting any liquid-phase heating medium within a second time interval; and a rapid cooling step, which comprises rapid cooling the laminated package filled with the product within a third time interval;

wherein the laminated package remains substantially dry throughout the pre-heating step, the hot-filling and sterilizing step, the holding step, and the rapid cooling step, thereby eliminating a post-drying process and reducing energy consumption and equipment cost.

2. The method according to claim 1, wherein the product is an acidic product with a pH value less than 4.6, wherein the acidic product is a fruit juice, a derivative of fruit juice, or a flavored and acidified drink.

3. The method according to claim 1, wherein the first time interval is about 5-15 seconds, and the temperature at which the product is subjected to the high-temp-short-time sterilization is about 90-110° C.

4. The method according to claim 1, wherein the effective sterilization temperature equal to the filling-moment temperature is about 80-100° C., and the second time interval is about 1-3 minutes.

5. The method according to claim 1, wherein the third time interval is about 5-7 minutes, and the laminated package and the product are cooled from 80-100° C. to 20-40° C. during the third time interval, and the rapid cooling step is carried out in a rapid cooling tunnel.

6. He method according to claim 1, wherein the laminated package filled with the product in the hot-filling and sterilizing step is sent into the heating and insulating tunnel through a first continuous conveyor belt, heated and insulated while passing through the heating and insulating tunnel, and then sent into the rapid cooling tunnel through a second continuous conveyor belt for rapid cooling.

7. A laminated packaging material hot filling and sterilization equipment, comprising:

a packaging machine for filling a product into a laminated package and sealing the laminated package, so that the temperature of the product is utilized to sterilize the laminated package, wherein before filling, the product is processed with a high-temp-short-time sterilization within a first time interval, and the temperature of the product at the moment of filling constitutes the effective sterilization temperature;

a heating and insulating tunnel, connected to the packaging machine, and configured to maintain the laminated package and the product at an effective sterilization temperature, equal to the filling-moment temperature, by non-liquid-phase heating, without contacting any liquid-phase heating medium, within a second time interval; and a rapid cooling tunnel, connected to the heating and insulating tunnel for rapidly cooling the laminated package filled with the product sent from the heating and insulating tunnel within a third time interval by non-liquid-phase cooling;

wherein the laminated package remains substantially dry throughout processing in the packaging machine, the heating and insulating tunnel, and the rapid cooling tunnel, thereby eliminating a post-drying process and reducing energy consumption and equipment cost.

8. The equipment according to claim 7, wherein the product is an acidic product with a pH value less than 4.6, and the acidic product is a fruit juice, a derivative of fruit juice, or a flavored and acidified drink.

9. The equipment according to claim 7, wherein the first time interval is about 5-15 seconds, and the temperature at which the product is subjected to the high-temp-short-time sterilization is about 90-110° C.

10. The equipment according to claim 7, wherein the effective sterilization temperature equal to the filling-moment temperature is about 80-100° C., and the second time interval is about 1-3 minutes.

11. The equipment according to claim 7, wherein the third time interval is about 5-7 minutes, and the laminated package and the product are cooled from 80-100° C. to 20-40° C. during the third time interval.

12. The equipment according to claim 7, further comprising a first continuous conveyor belt or a second continuous conveyor belt, wherein the first continuous conveyor belt is connected between the packaging machine and the heating and insulating tunnel for sending the laminated package filled with the product in the packaging machine into the heating and insulating tunnel, wherein the second continuous conveyor belt is connected between the heating and insulating tunnel and the rapid cooling tunnel for sending the laminated package, filled with the product and heated and insulated in the heating and insulating tunnel, to the rapid cooling tunnel for rapid cooling.

13. The equipment according to claim 7, further comprising a backend inline packaging station connected to the rapid cooling tunnel for receiving the laminated product that has been rapidly cooled and transferred from the rapid cooling tunnel for packaging.

* * * * *